United States Patent [19]

Harumoto et al.

[11] Patent Number: 4,588,972

[45] Date of Patent: May 13, 1986

[54] ELECTROMAGNETIC INDUCTION APPARATUS WITH COOLING GROOVES

[75] Inventors: Yoshinobu Harumoto, 6-5-13, Tokiwa-dai, Toyono-cho, Toyono County, Osaka; Yoshio Yoshida, 8, Sakuraga-oka 3-chome, City of Minoo, Osaka; Yuichi Kabayama, 18-5, Fujigao 6-chome, City of Katano, Osaka; Hisao Kan, Ako; Tetsuro Hakata, Ako; Takahiro Matsumoto, Ako, all of Japan

[73] Assignees: Yoshinobu Harumoto; Yoshio Yoshida; Yuichi Kabayama; Mitsubishi Denki Kabushiki Kaisha, all of Tokyo, Japan

[21] Appl. No.: 681,193

[22] Filed: Dec. 13, 1984

[30] Foreign Application Priority Data

Dec. 23, 1983 [JP] Japan ..... 58-243386

[51] Int. Cl.[4] ..... H01F 27/10

[52] U.S. Cl. ..... 336/58; 336/60

[58] Field of Search ..... 336/55, 57, 58, 60, 336/223, 185

[56] References Cited

U.S. PATENT DOCUMENTS

| | | | |
|---|---|---|---|
| 1,143,305 | 6/1915 | Nichols | 336/60 X |
| 1,156,680 | 10/1915 | Fortescue | 336/60 X |
| 1,331,896 | 2/1920 | Brand | 336/60 X |
| 1,580,811 | 4/1926 | Burnham | 336/60 |
| 2,853,657 | 9/1958 | Hofacker | 336/60 X |
| 3,071,845 | 1/1963 | Leonard et al. | 336/60 X |
| 3,151,304 | 9/1964 | Miller | 336/58 |
| 3,271,711 | 9/1966 | Beng | 336/58 X |
| 3,391,363 | 7/1968 | Moore | 336/60 X |
| 3,602,857 | 8/1971 | Robin | 336/60 |
| 4,255,849 | 3/1981 | Beck et al. | 336/60 X |

FOREIGN PATENT DOCUMENTS

| | | | |
|---|---|---|---|
| 1023064 | 3/1953 | France | 336/60 |
| 56-107527 | 8/1981 | Japan . | |

OTHER PUBLICATIONS

Ina et al., "Vapor-Cooled Transformers", Mitsubishi Electric Advance, Dec. 1982, pp. 1-3.

*Primary Examiner*—Thomas J. Kozma

*Attorney, Agent, or Firm*—Wenderoth, Lind & Ponack

[57] ABSTRACT

A transformer has a vertical winding assembly formed of a stack of pancake coils sandwiched between electrically insulating bases each provided on its surface contacted by an associated one of pancake coils with a plurality of cooling grooves extending in spaced relationship along turns of a rectangular electrically conductive wire forming the pancake coil and opening on the upper and lower portions of the base. A liquid refrigerant sprinkled on the winding assembly is arranged to flow through the cooling grooves via the upper open ends and be discharged via the lower open ends.

4 Claims, 4 Drawing Figures

ELECTROMAGNETIC INDUCTION APPARATUS WITH COOLING GROOVES

BACKGROUND OF THE INVENTION

This invention relates to an electromagnetic induction apparatus cooled with a liquid refrigerant sprinkled thereon, and more particularly to a cooling structure for sprinkling a liquid refrigerant on an electromagnetic induction apparatus, for example, a transformer from an upper portion thereof to cool it.

In a conventional transformer having the cooling structure of the type referred to a vertically disposed winding assembly has included a plurality of pancake coils, alternating electrically insulating bases each having spacers stuck to that surface contacted by a mating one of the pancake coils to form cooling ducts therebetween, and an iron core fitted into the winding assembly. A liquid refrigerant has been sprinkled on the winding assembly and the iron core from the upper ends thereof and flowed through the cooling ducts to cool a rectangular electrically conductive wire forming each of the pancake coils and the iron core after which the liquid refrigerant is cooled by an external cooler. The liquid refrigerant thus cooled is again sprinkled on the winding assembly and the iron core to repeat the process as described above. Under these circumstances, the sprinkled liquid refrigerant flows through the cooling ducts formed of the spacers stuck to the electrically insulating bases alternating with the pancake coils. This has resulted in the disadvantage that the liquid refrigerant can not uniformly cool the electrically conductive wire forming each of the pancake coils.

Accordingly, it is an object of the present invention to provide an electromagnetic induction apparatus having a new and improved cooling structure for uniformly cooling an electrically conductive wire forming each of coils involved.

SUMMARY OF THE INVENTION

The present invention provides an electromagnetic induction apparatus cooled with a liquid refrigerant sprinkled thereon which apparatus comprises an iron core, a vertically disposed winding assembly magnetically coupled to the iron core and including a plurality of pancake coils each formed by winding a rectangular electrically conductive wire around the iron core and a plurality of electrically insulating bases interposed between the plurality of pancake coils, each of the electrically insulating bases being provided on that surface thereof contacted by an associated one of the pancake coils with a plurality of cooling grooves extending in parallel spaced relationship along turns of the rectangular electrically conductive wire, the plurality of cooling grooves having one end opening on an upper portion of the electrically insulating base and the other ends opening on a lower portion thereof, so that the open ends of the plurality of cooling grooves on each of the upper and lower portions of the electrically insulating base are located on each side of the longitudinal central axis of the base to be symmetrical with those on the other side thereof with respect to the longitudinal central axis, and a refrigerant sprinkler disposed above the winding assembly and the iron core to sprinkle the liquid refrigerant on both the winding assembly and the iron core to cause to flow in the plurality of cooling grooves the sprinkled liquid refrigerant.

In a preferred embodiment of the present invention, each of the electrically insulating bases has a pair of opposite surfaces and is provided on one of the opposite surfaces with the plurality of cooling grooves as described in the preceding paragraph, and a different one of the pancake coils is sandwiched between each pair of the electrically insulating bases so as to be contacted by the surfaces of the opposite bases including the cooling grooves.

Advantageously, each of the electrically insulating bases may be further provided on each of the upper and lower portions of the surface thereof including the open ends of the cooling grooves with a plurality of inflow or exit grooves disposed in spaced relationship and in parallel to the longitudinal central axis of the base on each side of the longitudinal central axis to be symmetrical with those on the other side thereof with respect to the longitudinal axis, the plurality of inflow or exit grooves causing adjacent ones of the open ends of the cooling grooves to communicate with an outer periphery of the pancake coil.

BRIEF DESCRIPTION OF THE DRAWING

The present invention will become more readily apparent from the following detailed description taken in conjunction with the accompanying drawing in which.

DESCRIPTION OF THE PREFERRED EMBODIMENTS

Figure 1:
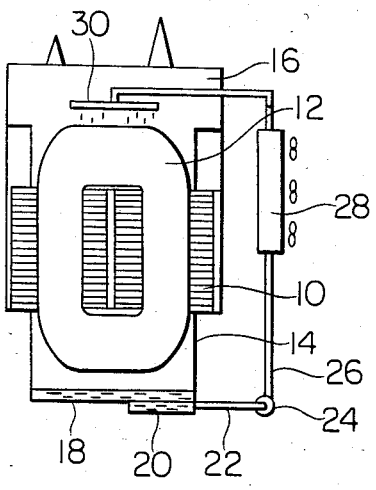
FIG. 1 PRIOR ART
FIG. 1 is a schematic longitudinal sectional view of a conventional transformer cooled by sprinkling a liquid refrigerant thereon with parts illustrated in front elevation.

For a better understanding of the nature of the present invention, a conventional transformer cooled with a liquid refrigerant sprinkled thereon from an upper portion thereof will now be described in conjunction with FIG. 1 of the drawing. The arrangement illustrated comprises an iron core 10, a winding assembly 12 in the form of a rounded rectangle electromagnetically coupled to the iron core 10 by having a central rectangular opening into which the iron core 10 is fitted, and a hermetic enclosure 14 for housing therein the winding assembly 12 with the iron core 10 so as to vertically dispose the longer sides of the rectangular winding assembly 12 with the iron core 10 suitably fixed on the opposite end surface to associated opposite side walls of the enclosure 14 to be horizontally located.

The winding assembly 12 includes a plurality of pancake coils alternating electrically insulating bases. Each of the pancake coils is formed of a rectangular electrically conductive wire flatly wound into a predetermined rounded rectangle having a central rectangular opening into which the iron core 10 is fitted as shown in FIG. 1. Also, each of the electrically insulating bases is similar in shape to the pancake coils and opposite to an associated one of the pancake coils through a plurality of cooling ducts formed therebetween of a plurality of spacers stuck to the surface of the electrically insulating base. Predetermined ones of the pancake coils are serially connected to one another to form a primary winding while the remaining pancake coils are also serially connected to one another to form a secondary winding. However, the pancake coils, the electrically insulating bases with the spacers, and the primary and secondary winding are not shown only for purposes of illustration.

The hermetic enclosure 14 is filled with an electrically insulating gas 16, for example, gaseous sulfur hexafluoride ($SF_6$) to electrically insulate the winding assembly 12. Furthermore, an amount of a liquid refrigerant 18 is shown in FIG. 1 as being kept at the bottom of the enclosure 14 and in a sump 20 disposed at the bottom of the enclosure 14. The liquid refrigerant 18 may comprise a fluorocarbon expressed by the chemical formula $C_8F_{10}O$ and commercially available under a trade mark "FC-75".

Outside of the enclosure 14 piping 22 is connected at one end to the sump 20 and therefore the liquid refrigerant 18 and at the other end to a refrigerant pump 24 subsequently connected to rising piping 26 in which a cooler 28 is connected. The cooler 28 is connected to a sprinkler 30 disposed within the enclosure 14 to be located above both the winding assembly 12 and the iron core 10.

In operation, the refrigerant pump 24 is operated to pump the liquid refrigerant 18 located at the bottom of the enclosure 14 and in the sump 20 to the cooler 28 through the piping 22 and 26. The liquid refrigerant 18 is cooled in the cooler 28 and then supplied to the sprinkler 30 through the piping connected thereacross. The sprinkler 30 sprinkles the liquid refrigerant 18 on both the iron core 10 and the winding assembly 12 from the upper portions thereof. The liquid refrigerant 18 thus sprinkled flows through the cooling ducts (not shown) disposed between the pancake coils and the adjacent electrically insulating bases and also cooling ducts (not shown) disposed on the periphery of the iron core 10. During the flow thereof through the cooling ducts, the sprinkled liquid refrigerant contacts the pancake coils and the iron core 10 to cool them after which it is discharged to the bottom of the enclosure 14 and then to the sump 20. At that time, the liquid refrigerant 18 itself has risen in temperature because it has cooled both the iron core 10 and the pancake coils 12. While the liquid refrigerant recirculates through the piping 22 and 26 by means of the operation of the refrigerant pump 24 the same is cooled by the cooler 28. Thus the liquid refrigerant 18 in the cooled state reaches the sprinkler 30.

Then the process as described above is repeated to continuously cool both the iron core 10 and the pancake coils.

In the conventional transformer as described above, the sprinkled liquid refrigerant is arranged to flow through cooling ducts defined by the spacers stuck to the surfaces of the electrically insulating bases interposed between the pancake coils. Thus, conventional electromagnetic induction apparatus such as the above-mentioned transformer have been disadvantageous in that the electrically conductive wires forming the respective pancake coils of the winding assembly 12 can not be uniformly cooled.

Accordingly, the present invention contemplates to eliminate the disadvantage of the prior art practice as described above, by the provision of an electrically insulating base vertically disposed and provided on that surface contacted by an associated one of pancake coils with a plurality of cooling grooves extending in parallel spaced relationship along turns of a rectangular electrical conductive wire forming each of the pancake coils and opening at one end on the upper portion of the electrically insulating base and at the other end on the lower portion thereof, and cooling means for causing flow the plurality of cooling grooves of a liquid refrigerant sprinkled on the electrically insulating bases and the pancake coil above the latter.

Figure 2:
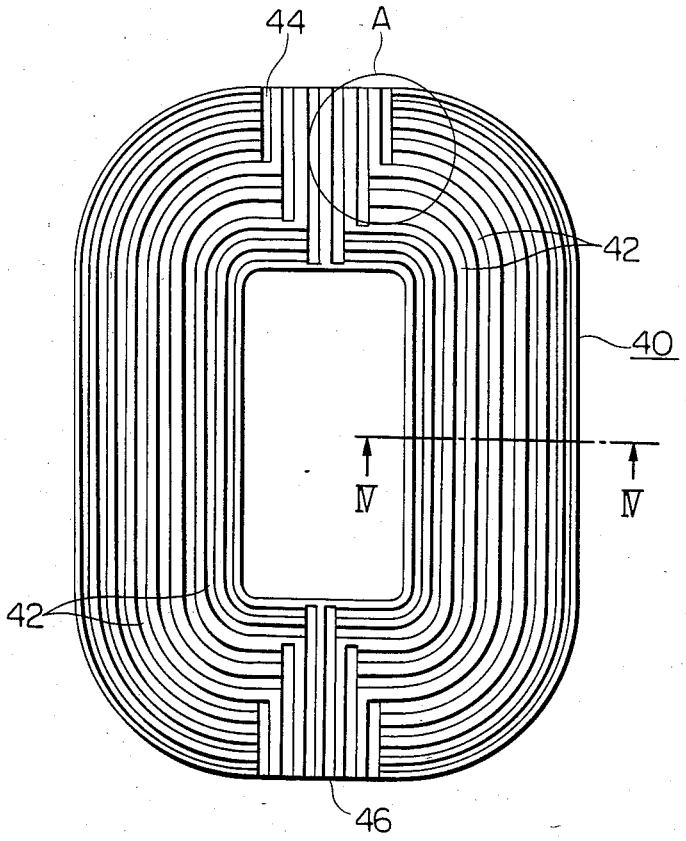
FIG. 2 is a front elevational view, in somewhat enlarged scale of one embodiment according to the electrically insulation base of the present invention used with a winding assembly such as shown in FIG. 1.

Referring now to FIG. 2, there is illustrated one embodiment according to the electrically insulating base of the present invention used with a winding assembly such as shown by the reference numeral 12 in FIG. 1. Also, transformers to which the electrically insulating base of the present invention is applied are similar in outlined general construction to the conventional transformer shown in FIG. 1 except for a specified surface configuration of the electrically insulating base.

As shown in FIG. 2, the electrically insulating base of the present invention generally designated by the reference numeral 40 has an outer periphery in the form of a rounded rectangle and an inner periphery in the form of a rectangle having sides parallel to those of the outer rectangle to form a rectangular opening into which an associated iron core (not shown) is arranged to be fitted.

The surface as shown in FIG. 2 of the electrically insulating base 40 is arranged to contact and electrically insulate a rectangular pancake coil formed of a rectangular electrically conductive wire wound to form turns arranged in the form of a flat rectangular spiral although the pancake coil and therefore the electrically conductive wire is omitted only for purposes of illustration.

In the example illustrated, the electrically insulating base 40 is similar in shape to the pancake coil but somewhat larger in outside dimension and somewhat smaller in inside dimension than the pancake coil. Also, the electrically insulating base 40 has the longitudinal central axis and therefore a pair of longer sides of the inner or outer periphery located in the vertical direction as in the arrangement of FIG. 1.

According to the present invention, the electrically insulating base 40 is provided on that surface thereof contacted by the pancake coil with a plurality of cooling grooves 42 extending in parallel, spaced relationship along the turns of the electrically conductive wire as described above. The plurality of cooling grooves 42 are preferably arranged in a predetermined radially equal intervals. As shown in FIG. 2, the cooling grooves 42 run in parallel to the outer and inner peripheries of the base 40 on the substantial portion of each of the opposite longer sides thereof, in this case, in the vertical direction and those portions of the cooling grooves 42 located on each of the upper and lower shorter sides of the base 40 run in parallel to the outer and inner peripheries of the base 40 or in the horizontal direction and thus so as not to cross over the turns of the coil, until the cooling grooves 42 having run on one of the longer sides of the base 40 open at respective ends opposite to ends at which the cooling grooves 42 open after they have run on the other of the longer sides of the base 40. Also, those opposite open ends are located to be symmetrical with each other about the longitudinal central axis of the base 40 and more separated from each other with those cooling grooves near to the outer periphery of the base 40.

Thus the plurality of cooling grooves 42 are divided into two groups symmetrical about the longitudinal central axis of the base 40.

It is noted that the cooling grooves 42 have a common width narrower than or almost equal to the width of the rectangular electrically conductive wire forming the pancake coil.

Also a plurality of port grooves, in this case, three grooves are disposed on each of the upper and lower shorter sides of the rectangular base 40 on each side of the longitudinal central axis thereof to be spaced from one another and parallel to the latter axis or vertical while being symmetrical with similar port grooves disposed on each of the shorter sides of the base 40 on the other side of the longitudinal central axis of the base 40 about the latter axis.

The port grooves include one end opening on the outer periphery of each of the associated shorter sides of the base 40 and the other end portions communicating with those cooling grooves 42 located on the same side of the longitudinal central axis of the base 40 as the port grooves one for each group including a plurality of the consecutive cooling grooves 42 with the other ends of the port grooves closed.

Thus the port grooves provide communication betwen the cooling grooves 42 and the outer periphery of the pancake coil.

Those port grooves designated by the reference numeral 44 are disposed on the upper shorter side as viewed in FIG. 2 of the base 40 to be vertical as described above while those port grooves designated by the reference numeral 46 are vertically disposed on the lower shorter side of the base 40.

Figure 3:
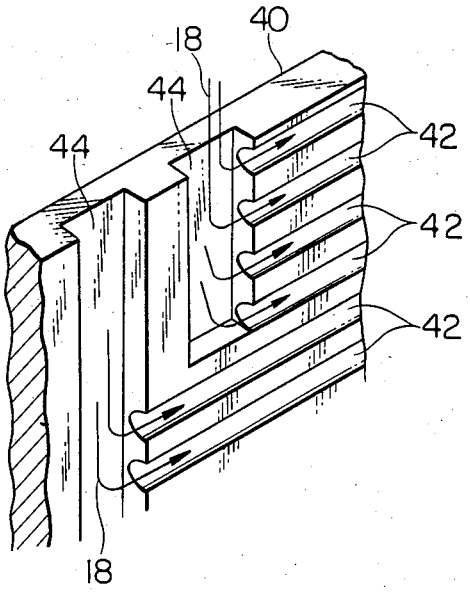
FIG. 3 is an enlarged fragmental perspective view of the part labelled A in FIG. 2.

As shown best in FIG. 3, the shortest one of the port grooves 44 or 46 is most remote from the longitudinal central axis of the base 40 to communicate with the outermost three cooling grooves 42 disposed on the outer peripheral portion of the base 40, and an intermediate one of the port grooves 44 or 46 communicates with at least two cooling grooves 42 located radially inside of the outermost three cooling grooves 42. The longest one of the port grooves 44 or 46 are located nearest to the longitudinal central axis of the base 46 and communicates with the remaining cooling grooves 42.

While FIG. 3 shows three port grooves located on each of the upper and lower shorter sides of the base 40 on each side of the longitudinal central axis thereof it is to be understood that any desired number of the port grooves may be used.

Then the pancake coil is sandwiched between a pair of electrically insulating bases 46 each having a groove pattern as described above in conjunction with FIG. 2 so as to be contacted by the grooved surfaces of the bases 40. In other words, the pancake coil is sandwiched between a pair of grooved surface members of an electrically insulating material to be connected together into a unitary structure although the unitary structure is not shown only for purposes of illustration.

Following this, a predetermined number of the unitary structures thus formed are stacked on one another so as to be fitted onto an associated iron core such as shown in FIG. 1 to be connected together into a winding assembly such as shown in FIG. 1.

Figure 4:
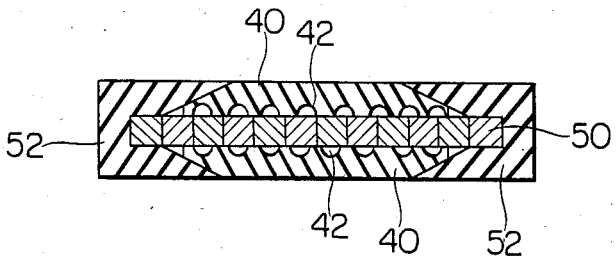
FIG. 4 is a cross-sectional view of one pancake coil of a winding assembly such as shown in FIG. 1 electrically insulated in accordance with a modification of the present invention with the cross section taken along a line similar in position to the line IV—IV of FIG. 2.

FIG. 4 shows a modification of the present invention. The arrangement illustrated comprises a pancake coil formed of a rectangular electrical conductive wire 50 wound into a plurality of turns, in this case, twelve turns, and sandwiched between a pair of electrically insulating bases 40 each provided on that surface thereof contacted by the pancake coil with a plurality of cooling grooves 42, in this case, eight grooves 42 and port grooves 44 and 46 (not shown) in a groove pattern such as described above in conjunction with FIG. 2. It is to be noted that FIG. 4 shows the width of the cooling groove 42 narrower than that of the electrically conductive wire 50 forming the pancake coil.

In the arrangement of FIG. 4, however, the electrically insulating base 46 is shorter in radial width between the outer and inner peripheries thereof than that shown in FIG. 2 so that the opposite bases 40 are not contacted by all the turns of the wire 50 but is permitted to be only contacted by the intermediate turns of the wire 50 except for the innermost and outermost turns of the wire 50 and the substantial portions of the turns next to the latter.

As shown in FIG. 4, each side of the rectangular electrically insulating base 40 has a cross section in the form of a trapezoid having a bottom side longer than the top side and contacted by the pancake coil.

Then a pair of inner and outer peripheral members 52 of an electrically insulating material are disposed to enclose in intimate contact relationship the inner and outer peripheries of the pancake coil to electrically insulate those portions of the wire 50 forming the inner and outer peripheral portions of the coil, respectively. Moreover, the inner and outer electrically insulating members 52 have an inner and an outer periphery identical to those shown in FIG. 2 and connected to opposite oblique surfaces of the trapezoidal base 40 to form a unitary structure having a rectangular cross section as shown in FIG. 4. This unitary structure includes the pancake coil formed of the electrically conductive wire 50, the pair of opposite electrically insulating bases 40, and the inner and outer peripheral members 52 formed of the electrically insulating material.

It will readily be understood that the resulting unitary structure has a cross section including the arrangement of FIG. 4 and a mirror image thereof located to be symmetrical with the latter arrangement about the longitudinal central axis of the unitary structure.

Then, a predetermined number of the unitary structures just described are stacked on one another so as to be fitted onto an associated iron core such as shown in FIG. 1 to form a winding assembly such as shown by the reference numeral 12 in FIG. 1.

The winding assembly as described above in conjunction with FIG. 2 or FIG. 4 is cooled in the manner as will subsequently be described. As in the arrangement of FIG. 1, the liquid refrigerant 18 is introduced within the piping 26 by the refrigerant pump 24 while the same is cooled by the cooler and sprinkled above the winding assembly with the iron core by the sprinkler 30. The liquid refrigerant 18 sprinkled above the winding assembly is introduced into the upper port grooves 44 acting as inflow grooves and flows through the mating cooling grooves 42 while passing along the associated conductive wires to cool them. Thereafter, the liquid refrigerant 18 is discharged to the bottom of the enclosure 14 through the lower port grooves 46 acting as exit grooves.

From the foregoing it is seen that the liquid refrigerant 18 flows through the cooling grooves 42 along the mating electrically conductive wires ensuring that the wires are uniformly cooled. Also, as described above, the cooling groove 42 is narrower in width than the electrically conductive wire, which ensures that the electrically insulating bases 40 firmly hold the electrically conductive wires. This results in a reliable structure capable of sufficiently withstanding any short-circuited mechanical force due to the occurrence of a short circuit fault or the like thereon.

From the foregoing it is seen that, according to the present invention, each of electrically insulating bases vertically disposed between pancake coils is provided on that surface thereof contacted by the pancake coil with a plurality of cooling grooves extending along turns of a rectangular electrically conductive wire forming the pancake coil and opening on the upper portion of the base at one end and on the lower portion thereof at the other end, and inflow and exit grooves for providing communication between for communicating the openings at both ends of each of the cooling grooves and an outer periphery of the associated pancake coil while a sprinkled liquid refrigerant is arranged to flow through the cooling grooves. Thus, the present invention provides an electromagnetic induction apparatus such as a transformer including cooling means for uniformly cooling an electrically conductive wire forming each of the pancake coils.

While the present invention has been illustrated and described in conjunction with a few preferred embodiments thereof it is to be understood than numerous changed and modifications may be resorted to without departing from the spirit and scope of the present invention. For example, the present invention has been illustrated and described in terms of an electrically insulating base provided only on one surface thereof with a plurality of cooling grooves and sandwiching each of the pancake coils between the same and an identical electrically insulating base, but it is to be understood that the present invention is equally applicable to a plurality of electrically insulating bases alternating the pancake coils. In the latter case, each of the electrically insulating bases is provided on each of the opposite surfaces with the cooling, inflow and exit grooves as described above with each of the grooved surface contacted by a different one of the pancake coils. While the present invention has been described in conjunction with a transformer it is to be understood that the present invention is equally applicable to other types of electromagnetic induction apparatus, for example, reactors.

Also by selecting a liquid refrigerant having appropriate magnitudes of its specific heat, heat capacity, viscosity etc., the heat transfer and the heat transport can readily be increased. This results in the advantages that associated cooling grooves are diminished and auxiliary losses are decreased while a mating cooling system is simplified. A combination of the electrically insulating sulfur hexafluoride ($SF_6$) gas and the liquid refrigerant expressed by the chemical formula $C_8F_{16}O$ as described above is effective for accomplishing the advantages just described.

What we claim is:

1. An electromagnetic induction apparatus cooled with a liquid refrigerant sprinkled thereon which apparatus comprises an iron core, a vertically disposed winding assembly magnetically coupled to said iron core and including a plurality of serially adjacent pancake coils each formed in a vertical plane of a rectangular electrically conductive wire wound around said iron core, and a plurality of electrically insulating bases interposed between adjacent ones of said plurality of pancake coils, each of said electrically insulating bases being provided on a surface thereof contacted by an associated one of said pancake coils with a plurality of cooling grooves extending from an upper central portion of said pancake coils to a lower central portion of said pancake coils along vertical side portions and upper and lower curved portions of said turns of said wire in parallel, spaced relationship along and in contact with turns of said electrically conductive wire so as not to cross over said turns and so as to define lands between said cooling grooves contacting said pancake coils, each of said plurality of cooling grooves being narrower than the width of said wire and having one end opening on an upper central portion of said electrically insulating base and an opposite end opening on a lower central portion thereof so that said open ends of said plurality of cooling grooves on each of said upper and lower central portions of said electrically insulating base are symmetrically located on opposite sides of a vertically extending longitudinal central axis of said base, and a refrigerant sprinkler disposed above said winding assembly and said iron core to sprinkle said liquid refrigerant on both said winding assembly and said iron core to flow in said plurality of cooling grooves, wherein each of said electrically insulating bases is further provided on the surface of the upper and lower central portions thereof, including said open ends of said cooling groove, with a plurality of inflow and exit grooves disposed in spaced relationship and in parallel to said longitudinal axis on each side of the longitudinal axis symmetrically with respect to said longitudinal axis, said plurality of inflow and exit grooves providing adjacent ones of said open ends of said cooling grooves with communication with an outer periphery of said pancake coil.

2. An electromagentic induction apparatus as claimed in clim 1 wherein each of said electrically insulating bases has a pair of opposite surfaces having said cooling grooves therein, and a different one of said pancake coils is sandwiched between each adjacent pair of said electrically insulating bases so as to be contacted by said surfaces of said opposite bases including said cooling grooves.

3. An electromagnetic induction apparatus as claimed in claim 2 wherein each of said electrically insulating bases further includes said inflow and exit grooves on said opposite surfaces thereof including said cooling grooves.

4. An electromagnetic induction apparatus as in claim 1, wherein more than one of said cooling grooves open into an associated one of said inflow grooves and an associated one of said exit grooves at said open ends.

* * * * *